US011058220B2

(12) United States Patent
Fletcher et al.

(10) Patent No.: US 11,058,220 B2
(45) Date of Patent: Jul. 13, 2021

(54) DESK WITH SEATING

(71) Applicant: The Prophet Corporation, Owatonna, MN (US)

(72) Inventors: Laura Ann Fletcher, Owatonna, MN (US); Ryan William Rasell, Apple Valley, MN (US); Caleb Summers, St. Louis Park, MN (US)

(73) Assignee: THE PROPHET CORPORATION, Minneapolis, MN (US)

( * ) Notice: Subject to any disclaimer, the term of this patent is extended or adjusted under 35 U.S.C. 154(b) by 0 days.

(21) Appl. No.: 16/431,328

(22) Filed: Jun. 4, 2019

(65) Prior Publication Data

US 2020/0383473 A1 Dec. 10, 2020

(51) Int. Cl.
*A47B 83/02* (2006.01)

(52) U.S. Cl.
CPC ..... *A47B 83/02* (2013.01)

(58) Field of Classification Search
CPC ... A47B 83/02; A47B 39/00; A47B 2083/025; A47B 83/008; A47C 3/029; A47C 3/026; A47C 7/68
USPC ..... 297/271.5, 153, 195.11
See application file for complete search history.

(56) References Cited

U.S. PATENT DOCUMENTS

| | | | | | |
|---|---|---|---|---|---|
| 134,668 | A | * | 1/1873 | Henrichs | A47D 1/08 297/131 |
| 2,988,358 | A | * | 6/1961 | Mills | A63G 23/00 472/135 |
| D198,679 | S | | 7/1964 | Cartner | |
| 3,563,605 | A | | 2/1971 | Pinkas | |
| 3,604,749 | A | | 9/1971 | Parmett et al. | |
| D228,095 | S | | 8/1973 | Schmitt | |
| D232,499 | S | | 8/1974 | Martinelli | |
| D232,504 | S | | 8/1974 | Archinal | |
| D234,933 | S | | 4/1975 | Burke | |
| 5,226,865 | A | | 7/1993 | Chin | |
| 5,810,751 | A | * | 9/1998 | Meier | A47C 9/002 482/131 |
| D498,067 | S | | 11/2004 | Van Dyke | |
| D530,106 | S | * | 10/2006 | Van Erum | D6/338 |
| D586,574 | S | | 2/2009 | Gomree | |
| D605,862 | S | * | 12/2009 | Weeks | D6/338 |
| D625,931 | S | | 10/2010 | Estrup | |

(Continued)

FOREIGN PATENT DOCUMENTS

| | | | | |
|---|---|---|---|---|
| FR | 781523 A | * | 5/1935 | A47C 4/18 |
| JP | 8-112155 A | | 5/1995 | |

OTHER PUBLICATIONS

Plastic Round Stools, Retrieved May 2, 2018 from URL: <http://www.umaplastics.com/plastic-round-stools.html>, 5 pages.

(Continued)

*Primary Examiner* — Milton Nelson, Jr.
(74) *Attorney, Agent, or Firm* — Merchant & Gould P.C.

(57) ABSTRACT

An active desk includes a base having a convex surface defining at least one rocking path; a frame coupled to the base at an opposite end from the convex surface; a desk mounted to the frame; and a seat mounted to the frame at a location spaced between the base and the desk. A study seat includes a base; a frame extending upwardly from the base; a desk mounted to the frame and laterally offset from the base; and a seat mounted to the frame and laterally offset from the desk.

2 Claims, 9 Drawing Sheets

(56) References Cited

U.S. PATENT DOCUMENTS

| | | | |
|---|---|---|---|
| D647,313 | S | 10/2011 | Chen |
| D650,184 | S | 12/2011 | Hsu |
| D671,757 | S | 12/2012 | Walker et al. |
| D728,951 | S | 5/2015 | Yoshida |
| 9,167,899 | B2 | 10/2015 | Jackson |
| D767,290 | S | 9/2016 | Walser |
| D791,523 | S | 7/2017 | Bernard |
| D809,309 | S | 2/2018 | Theesfeld |
| D809,310 | S | 2/2018 | Mathur et al. |
| D809,809 | S | 2/2018 | Theesfeld et al. |
| D812,919 | S | 3/2018 | Kim |
| D830,710 | S | 10/2018 | Harguth et al. |
| 2010/0066139 | A1 | 3/2010 | Woodring |
| 2019/0098998 | A1 | 4/2019 | Harguth et al. |

OTHER PUBLICATIONS

Play with a Purpose Catalog; Spring 2017; © 2017 Gopher Sport; 4 pages.

Thick plastic small round stools, home adult children bathroom stool, changing his shoes stool, Retrieved May 2, 2018 from URL: <https://www.aliexpress.com/item/Thick-plastic-small-round-stools-home-adult-children-bathroom-stool-changing-his-shoes-stool/32507580751.html, 17 pages.

TiltED Active Seats, Retrieved May 2, 2018 from URL: https://www.gophersport.com/pe/active-classroom/tilted-active-seats?item=25259&pt_source=googleads&pt_med i um =cpc&pt_campaign=Shopping_-_%E2%80%A6, 2 pages.

* cited by examiner

DESK WITH SEATING

BACKGROUND

Active seating allows a user freedom of movement while remaining seated. For example, a user may be able to pivot, rotate, or otherwise move the seat while sitting in the seat. Other seating includes pedals or other structures that can be moved by the user while the user remains seated. Standing desks allow a user to move between sitting and standing positions.

Improvements are desired.

SUMMARY

Some aspects of the disclosure are directed to an active desk (e.g., writing surface) with seating. The active desk includes a seat carried with the desk when the desk tilts about a convex base. For example, such an active desk could be used in a classroom setting. A child can sit on the seat during lessons and hold books and/or paper on the desk. The child can rock (e.g., forward-and-backwards, side-to-side, in circles, etc.) about the convex base when utilizing the active desk.

Other aspects of the disclosure include a study seat including a frame extending upwardly from a base, a desk mounted to the frame and laterally offset from the base, and a seat laterally offset from the desk. The seat is mounted to the frame at a location spaced along a height of the frame between the base and the desk. The frame has a smaller cross-sectional area than the base at each point along the height of the frame.

In certain implementations, the desk extends laterally from the frame in a first direction and the seat extends laterally from the frame in a second direction that is opposite the first direction. In certain examples, the seat is substantially laterally aligned with the base. In certain examples, the desk is larger than the seat.

In certain implementations, the convex surface defines multiple rocking paths. In certain examples, the convex surface is defined by a spherical cap.

In certain implementations, the unit is formed from multiple pieces. In certain examples, the base is defined by a first piece, the seat is defined by a second piece, and the desk is defined by a third piece. In certain examples, the desk and the seat are fixed relative to each other when the pieces are assembled together.

In certain implementations, the frame has a smaller cross-sectional area than the base along a height of the frame. In certain examples, portions of the frame may be contoured (e.g., between the base and the seat). In certain examples, the seat may be contoured. In certain examples, the desk may be angled relative to the seat.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Figure 1:
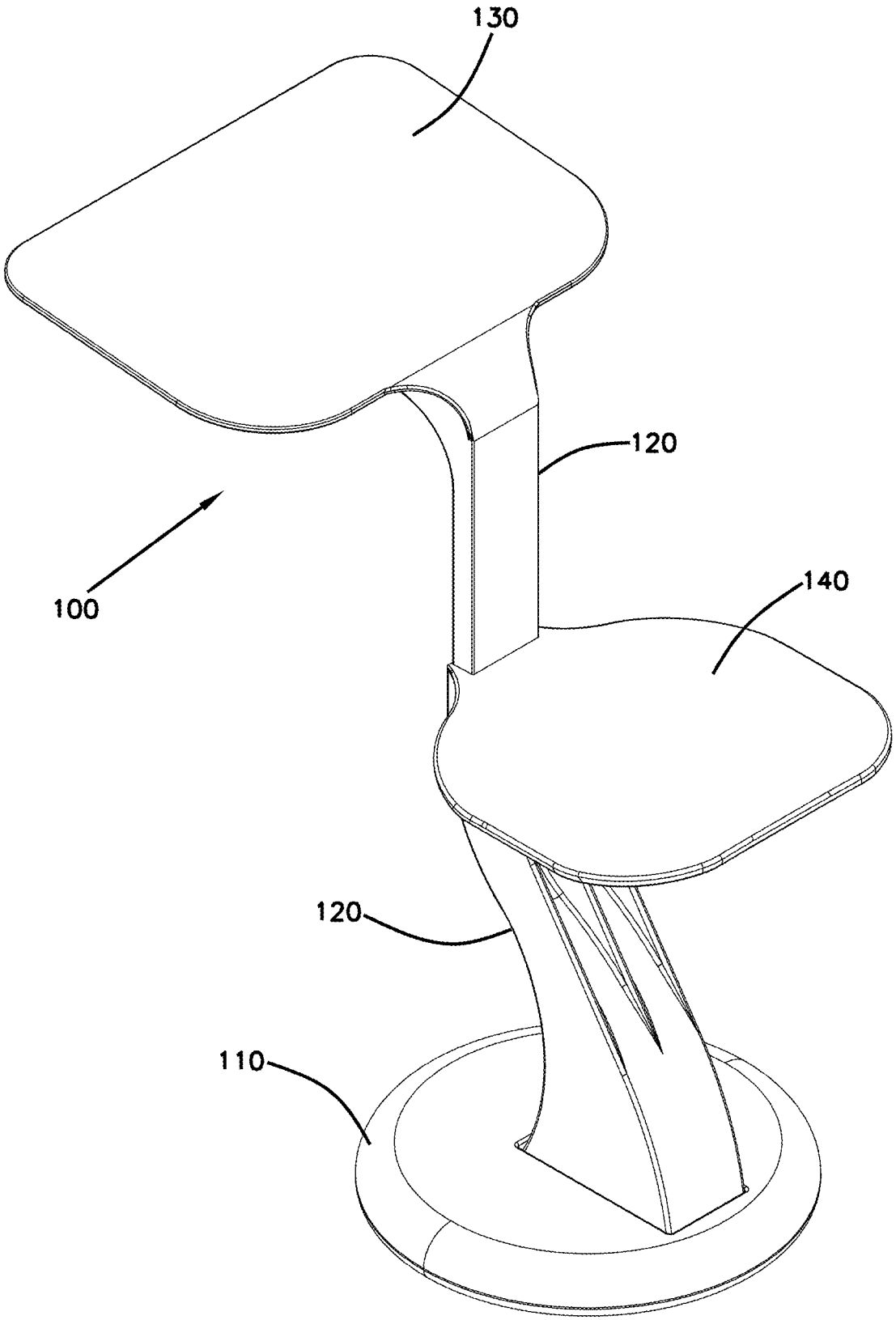
FIG. 1 is a top perspective view of an example active desk configured in accordance with the principles of the present disclosure, the active desk including a convex base, a desk, and a seat.
Figure 2:
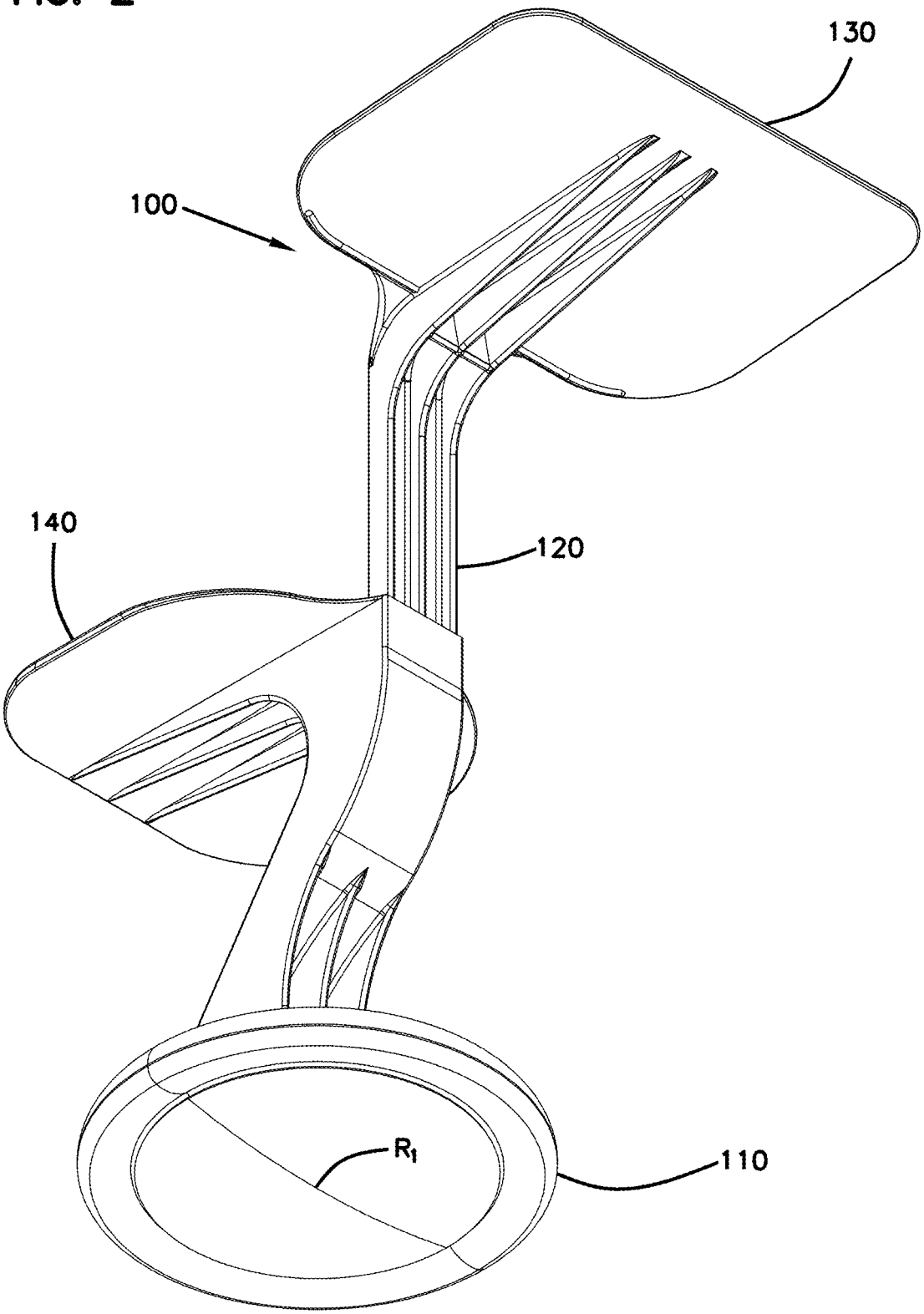
FIG. 2 is a bottom perspective view of the active desk of FIG. 1.
Figure 3:
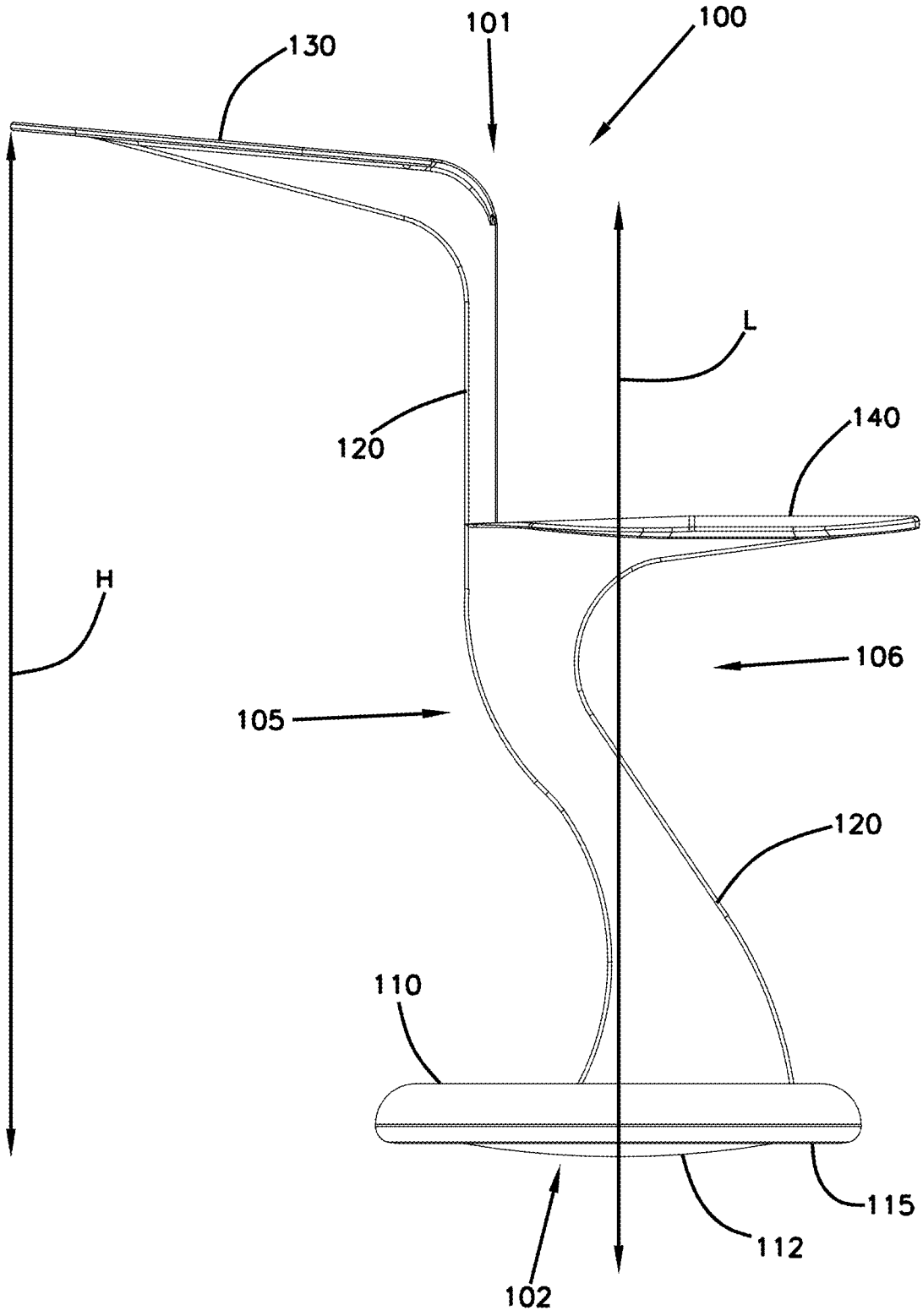
FIG. 3 is a first side elevational view of the active desk of FIG. 1.
Figure 4:
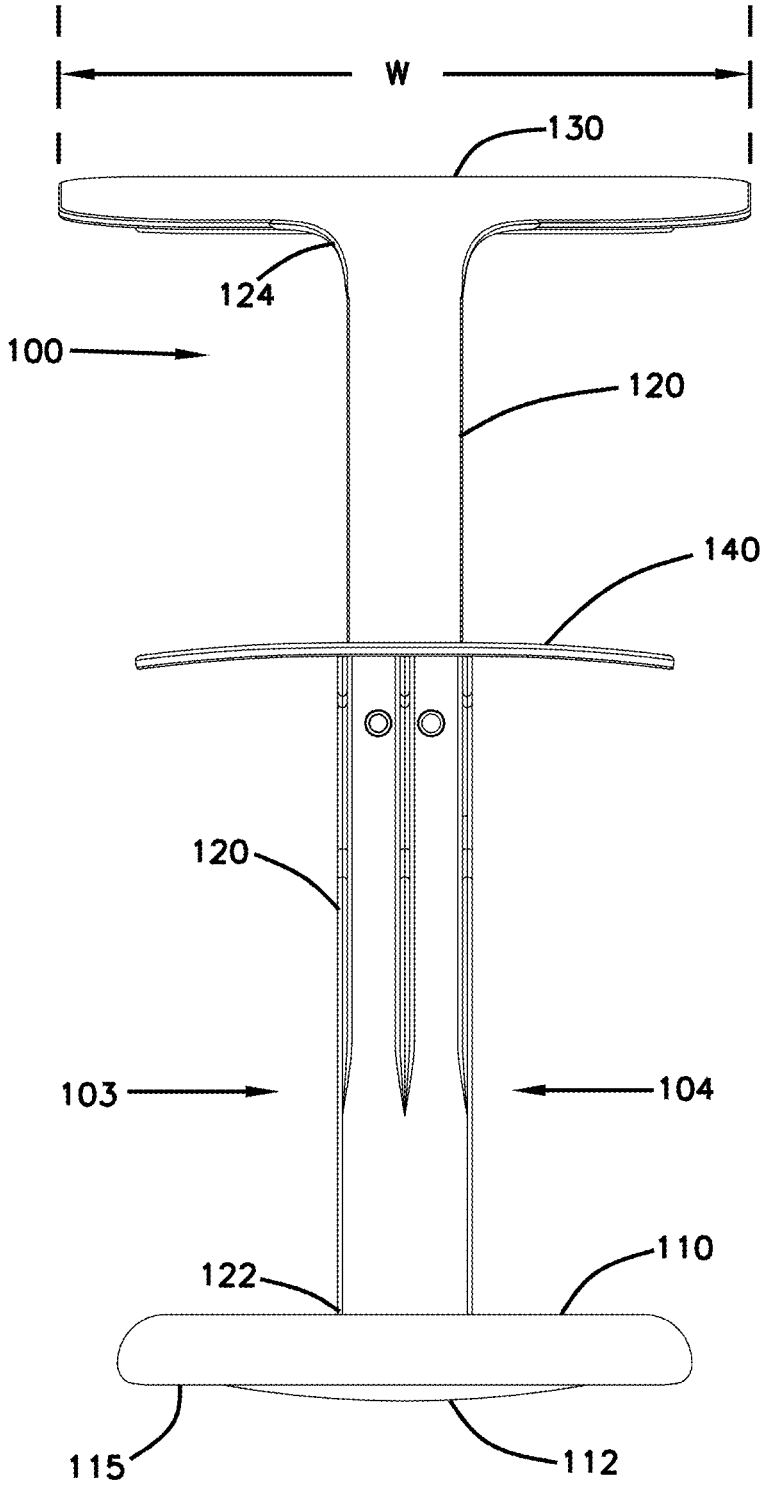
FIG. 4 is a first end elevational view of the active desk of FIG. 1.

Reference will now be made in detail to exemplary aspects of the present disclosure that are illustrated in the accompanying drawings. Wherever possible, the same reference numbers will be used throughout the drawings to refer to the same or like parts.

Some aspects of the present disclosure are directed to an active desk and seating unit. Other aspects of the present disclosure are directed to a study seat including an integral desk.

Referring to FIGS. 1-5, an example active desk and seating unit 100 includes both a desk 130 and a seat 140 that move together as a unit. The desk and seating unit 100 extends along a height H (FIG. 3) between a bottom 101 and a top 102, along a width W (FIG. 4) between first and second sides 103, 104, and along a depth D (FIG. 5) between a front 105 and a rear 106.

The active desk and seating unit 100 includes a base 110 defining a convex surface 112; a frame 120 coupled to the base 110 at an opposite end from the convex surface 112; a desk 130 mounted to the frame 120; and a seat 140 mounted to the frame 120. In certain examples, the seat 140 is disposed at a location spaced between the base 110 and the desk 130. The active desk and seating unit 100 enables the desk 130 to tilt relative to a floor F along one or more rocking paths. In certain implementations, the seat 140 tilts along with the desk 130.

Figure 6:
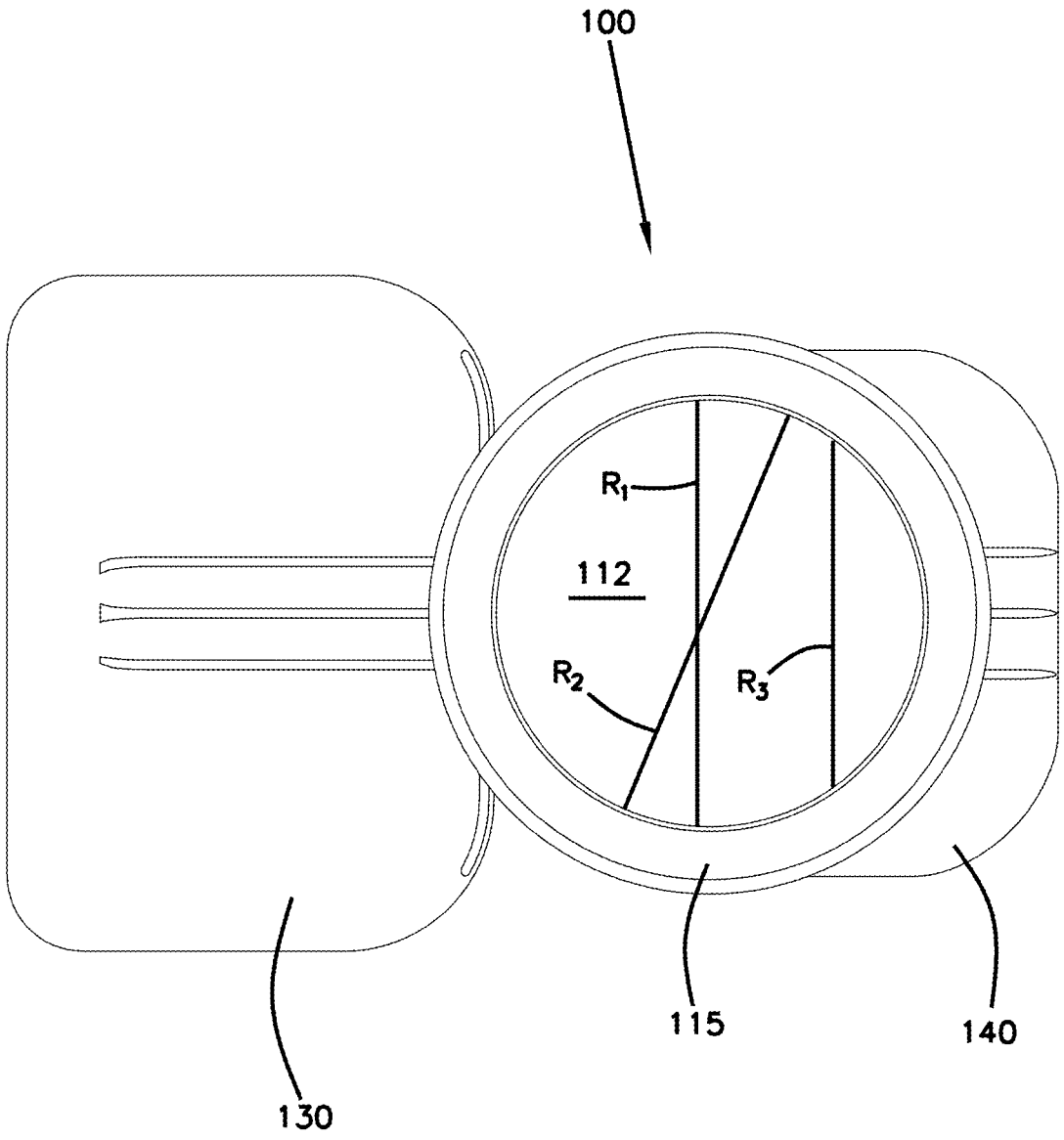
FIG. 6 is a bottom plan view of the active desk of FIG. 1.

As shown in FIG. 6, in certain examples, the convex surface 112 defines a plurality of rocking paths (e.g., see rocking paths R1, R2, and R3) along which the desk and seating unit 100 can be tilted. For simplicity, three example rocking paths R1, R2, R3 are illustrated. It will be understood by a person skilled in the art that the convex surface 112 provides additional rocking paths. In certain examples, the rocking paths are rotationally offset from each other (e.g., compare rocking paths R1 and R2), thereby allowing a user to rock along different directions (e.g., forward-rearward, side-to-side, etc.). In certain examples, the rocking paths are laterally offset from each other (e.g., compare rocking paths R1 and R3), thereby allowing a user to rock in the same direction at different tilt angles.

In certain examples, the base 110 has a circular profile. In an example, the convex surface 112 defines a spherical cap. Accordingly, the convex surface 112 has an infinite number of rocking paths. In other examples, the convex surface 112 may have other contoured shapes. In certain examples, the base 110 has an oblong profile.

In certain examples, stop portions 115 of the stool 100 extend laterally outwardly beyond the convex surface 112. In the example shown in FIG. 6, the stop portions 115 surround the convex surface 112. The rocking paths R1, R2, R3 end at the stop portions 115. Accordingly, the stop portions 115 inhibit further tilting of the desk and seating unit 100 along the rocking paths R1, R2, R3.

Figure 7:
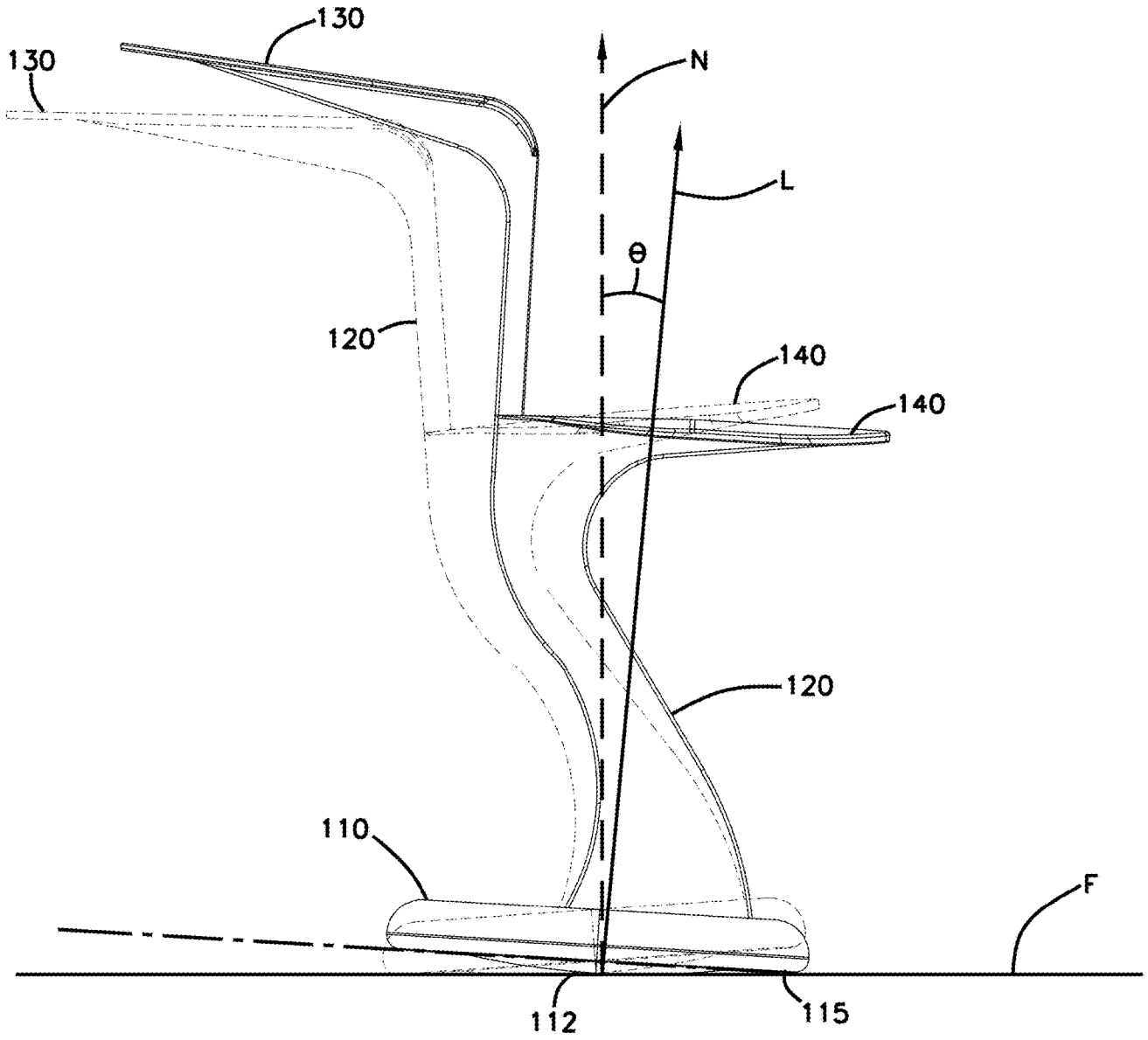
FIG. 7 is a first side elevational view of the active desk of FIG. 1 tilted to a first position along a first rocking path.
Figure 8:
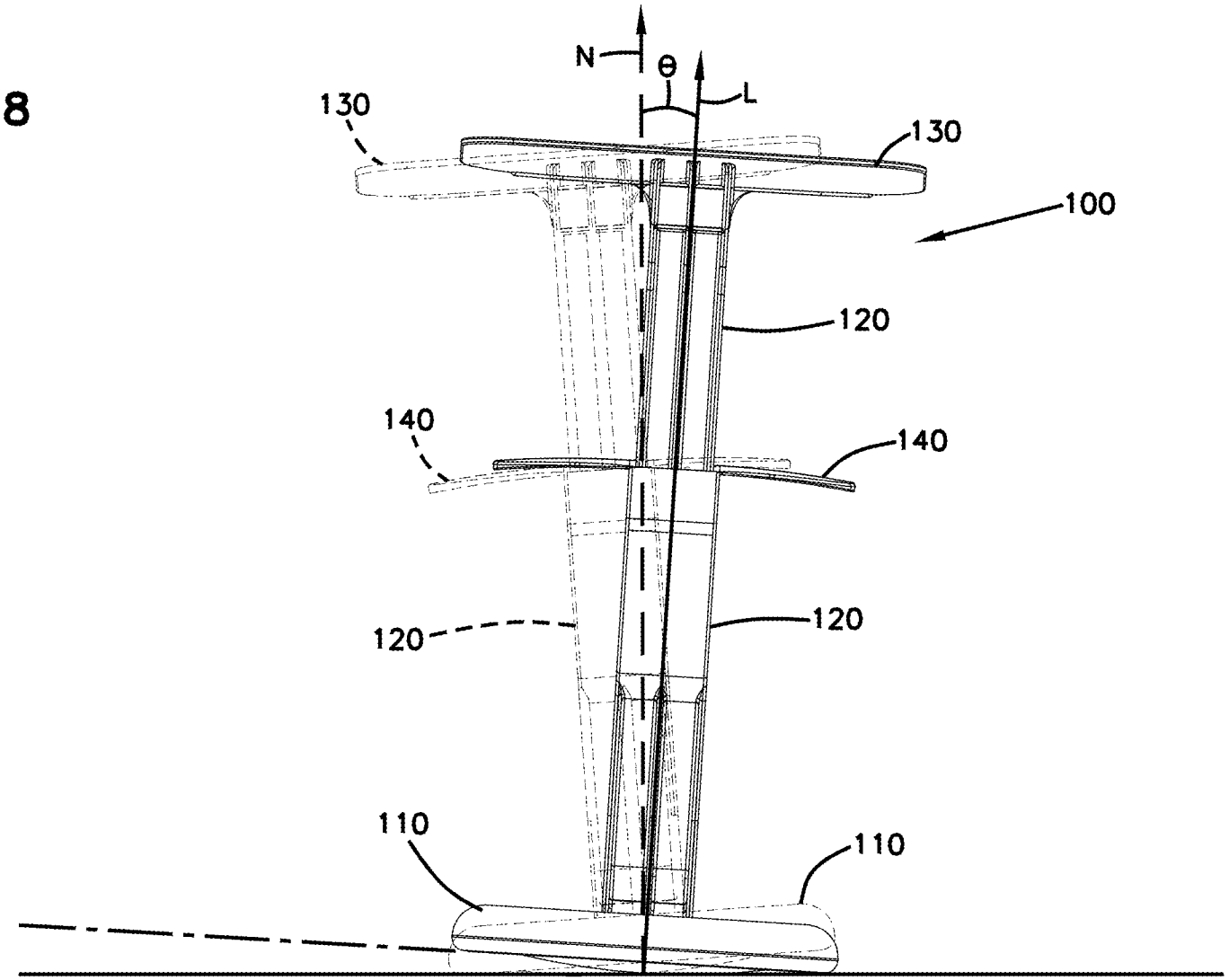
FIG. 8 is a first end elevational view of the active desk of FIG. 1 tilted to a second position along a second rocking path.

As shown in FIGS. 7 and 8, as the desk and seating unit 100 tilts along the rocking path R1, there is a change in angle θ between a central longitudinal axis L of the base 110 and a reference axis N normal to a floor F on which the desk and seating unit 100 is disposed. In certain implementations, the convex surface 112 allows the desk and seating unit 100 to tilt up to an angle θ of 45 degrees in either direction along the rocking path R1. In certain implementations, the convex surface 112 allows the desk and seating unit 100 to tilt up to an angle θ of 40 degrees in either direction along the rocking path R1. In certain implementations, the convex surface 112 allows the desk and seating unit 100 to tilt up to an angle θ of 35 degrees in either direction along the rocking path R1. In certain implementations, the convex surface 112 allows the desk and seating unit 100 to tilt up to an angle θ of 30 degrees in either direction along the rocking path R1. In certain implementations, the convex surface 112 allows the desk and seating unit 100 to tilt at an angle θ of between about 5 degrees and about 45 degrees in either direction along the rocking path R1. In certain implementations, the convex surface 112 allows the desk and seating unit 100 to tilt at an angle θ of between about 10 degrees and about 35 degrees in either direction along the rocking path R1. In certain implementations, the convex surface 112 allows the desk and seating unit 100 to tilt at an angle θ of between about 15 degrees and about 25 degrees in either direction along the rocking path R1.

Figure 5:
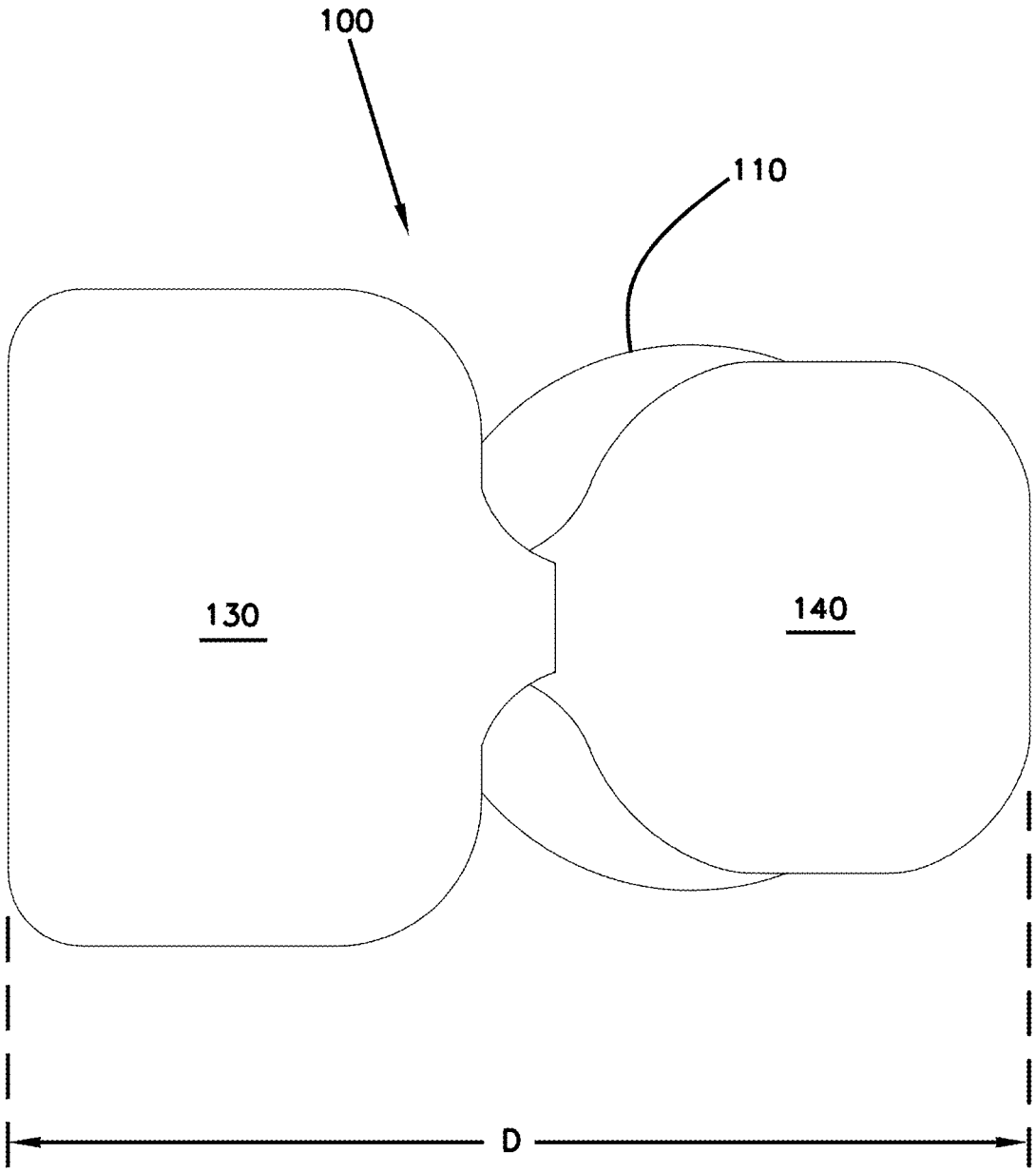
FIG. 5 is a top plan view of the active desk of FIG. 1.

The frame 120 extends between a first end 122 and a second end 124. The first end 122 is coupled to the base 110. The second end 124 is coupled to the desk 130. As shown in FIG. 5, the desk 130 extends laterally from the frame 120 in a first direction and the seat 140 extends laterally from the frame 120 in a second direction that is opposite the first direction. In the example shown, the seat 140 does not have a backrest. In other examples, a backrest may extend upwardly from the seat 140. In the example shown, the seat 140 does not have armrests. In other examples, armrests may extend outwardly from a backrest or from the frame 120. In certain implementations, strength ribs may extend between the frame 120 and the desk 130 and/or between the frame 120 and the seat 140.

By spacing the seat 140 between the base 110 and the desk 130, the desk and seat unit 100 allows users to sit down without first lowering themselves all the way to the floor. Rather, a user may easily sit on the seat 140 by straddling the seat 140 and frame 120. The lack of backrest and armrests facilitate straddling the seat 140. In some implementations, the seat 140 is planar. In other implementations, the seat 140 is contoured for comfort and/or ease of transitioning to a sitting position. In the example shown, the seat 140 may define a convex curvature along the width W of the unit 100 (e.g., see FIG. 4). In other examples, the seat 140 may define a convex curvature along the depth D of the unit 100, or along both the width W and the depth D. In still other examples, the seat 140 may define a concave curvature along the width W and/or the depth D.

Once seated, the desk 130 is located in front of the user. In certain implementations, the desk 130 is angled relative to the seat 140. In some examples, the desk 130 is flat relative to the floor F and the seat 140 is angled relative to the floor F when the unit 100 is untilted (i.e., when the central longitudinal axis L of the base 110 extends normal to the floor F). In other examples, the desk 130 is angled relative to the floor F while the seat 140 is generally flat relative to the floor F when the unit 100 is untilted (e.g., see FIG. 3). In certain examples, the desk 130 is angled between 0 degrees and 45 degrees relative to the floor F. In certain examples, the desk 130 is angled between 5 degrees and 35 degrees relative to the floor F. In certain examples, the desk 130 is angled between 10 degrees and 25 degrees relative to the floor F. In certain examples, the desk 130 is angled between 5 degrees and 20 degrees relative to the floor F. In certain examples, the desk 130 is angled between 0 degrees and 15 degrees relative to the floor F.

In certain implementations, the seat 140 is substantially aligned with the base 110 along the height H of the desk and seating unit 100. For example, as shown in FIG. 5, a majority of the surface area of the seat 140 overlaps with a majority of the surface area of the base 110 as viewed from a top plan orientation when the unit 100 is untilted. In certain implementations, a majority of the desk 130 does not overlap with the base 110. Rather, a majority of the desk 130 is laterally offset from the base 110 (e.g., see FIG. 5).

In certain examples, the desk 110 has an oblong profile. In certain examples, the seat 140 has an oblong profile. In certain implementations, the desk 130 is larger than the seat 140. In some examples, the desk 130 is deeper than the seat 140. In other examples, the desk 130 is the same depth as the seat 140. In other examples, the desk 130 is less deep than the seat 140. In some examples, the desk 130 is wider than the seat 140 (e.g., see FIG. 5). In other examples, the desk 130 is the same width as the seat 140. In other examples, the desk 130 is less wide than the seat 140.

Figure 9:
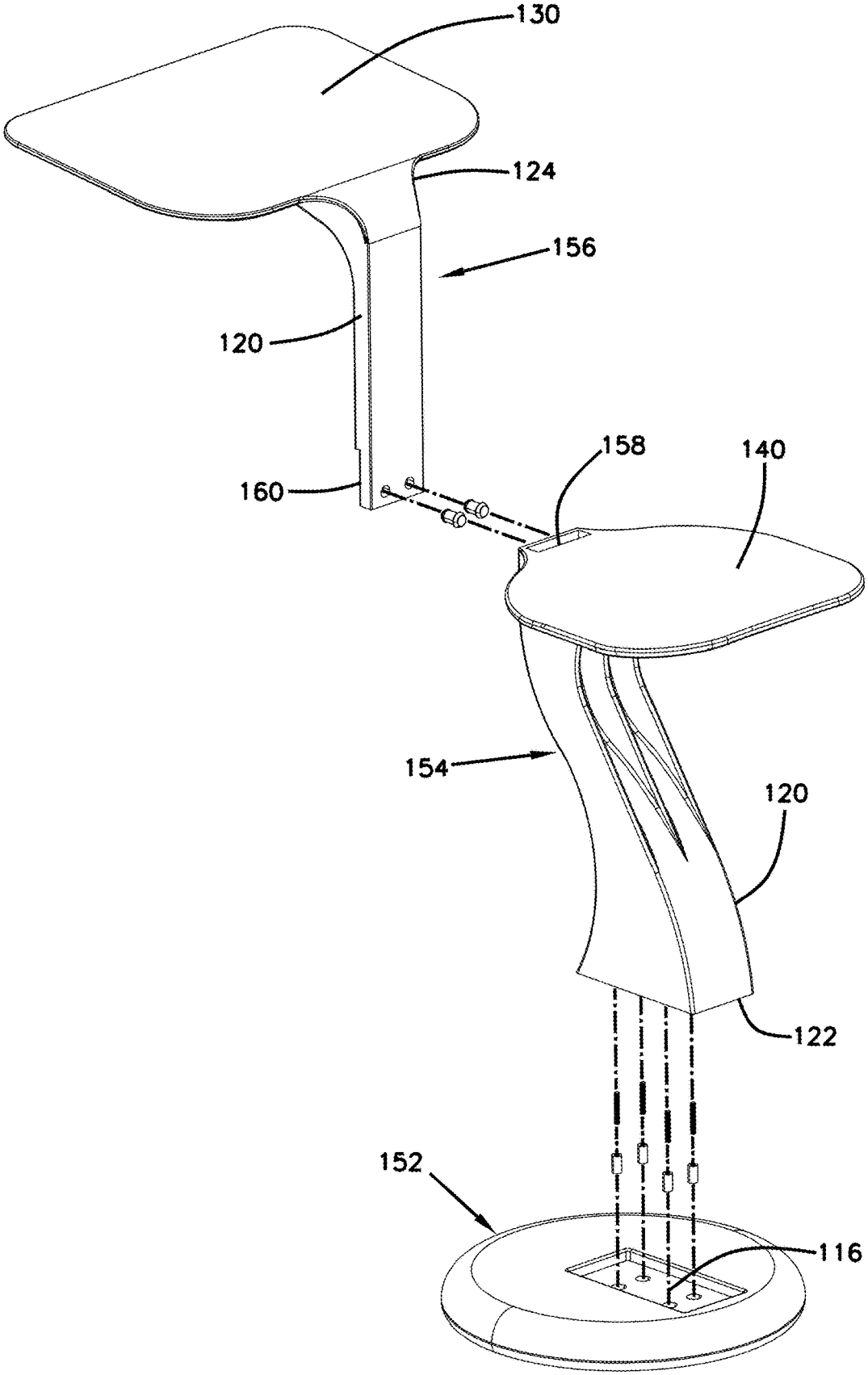
FIG. 9 is a perspective view of the active desk shown with example shipping components shown exploded away from each other.

As shown in FIG. 9, the desk and seating unit 100 can be assembled from multiple parts. In the example shown, the unit 100 includes a base piece 152, a seat piece 154, and a desk piece 156. The pieces 152, 154, 156 can be separated to facilitate packaging and/or shipping. To assemble, the seat piece 154 is coupled to the base piece 152, and the desk piece 156 is coupled to the seat piece 154. Once assembled, the base piece 152, the seat piece 154, and the desk piece 156 are fixed relative to each other. In certain examples, once assembled, the seat 140 and the desk 130 are fixed relative to each other.

Two or more of the pieces 152, 154, 156 cooperate to form the frame 120. In the example shown, the seat piece 154 and desk piece 156 cooperate to form the frame 120. In particular, the seat piece 154 defines the first end 122 of the frame 120 and the desk piece 156 defines the second end 124 of the frame 120. In other implementations, other piece configurations are possible. In certain implementations, the frame 120 is contoured along the height H of the unit 100. In certain implementations, the frame 120 is contoured at least between the base 110 and the seat 140. In certain examples, the frame 120 has a smaller cross-sectional area than the base 110 at each point along a height of the frame 120 (e.g., see FIGS. 3 and 4).

In the example shown, the base piece 152 defines a depression 116 in which the first end 122 of the frame 120 mounts. One or more fasteners extend through the base piece 152 and seat piece 154 to hold the pieces together. In other examples, the base piece 152 and seat piece 154 may be otherwise mechanically coupled together (e.g., glued, latched, friction-fit, etc.). In the example shown, the seat piece 154 defines a slot 158 and the desk piece 156 defines a tab 160 that fits in the slot 158. One or more fasteners extend through the seat piece 154 and desk piece 156 to hold the pieces together. In other examples, the seat piece 154 and desk piece 156 may be otherwise mechanically coupled together (e.g., glued, latched, friction-fit, etc.).

In accordance with other aspects of the disclosure, the active desk and seating unit 100 could also be characterized as a study seat 100 including a base, a seat, and a desk coupled together as an integral unit. The desk 130 is laterally offset from the base 110 and the seat 140 is laterally offset from the desk 130. In certain examples, the seat 140 has a similar profile size to the base 110. In certain examples, the seat 140 is substantially laterally aligned with the base 110. In certain implementations, the height H of the study seat 100 is larger than the width W and is larger than the depth D.

In certain implementations, the study seat 100 is an active study seat 100. In such implementations, the base 110 has a convex surface 112 defining at least one rocking path about which the seat 140 may tilt. In certain examples, the desk 130 tilts with the seat 140. In certain examples, the convex surface 112 defines multiple rocking paths.

Having described the preferred aspects and implementations of the present disclosure, modifications and equivalents of the disclosed concepts may readily occur to one skilled in the art. However, it is intended that such modifications and equivalents be included within the scope of the claims which are appended hereto.

What is claimed is:

1. A study seat comprising:

a base having a bottom side facing in a first direction and an opposite top side facing in an opposite second direction, the base having a periphery extending between the bottom side and the top side, the bottom side being configured to engage a surface to support the study seat, the bottom side of the base including a convex surface defining a plurality of rocking paths along each of which the base is tiltable relative to the surface, the rocking paths being rotationally offset from each other;

a first frame section extending from the top side of the base in the second direction;

a seat coupled to the first frame section so that the seat is spaced from the base in the second direction;

a second frame section extending from the seat in the second direction; and a desk coupled to the second frame section so that the desk is spaced from the seat in the second direction, the desk being offset from the base so that the desk extends outwardly beyond the periphery of the base, and the desk and the seat being fixed relative to each other once assembled.

2. The study seat of claim 1, wherein the first frame section extends along a first height between the base and the seat and the second frame section extends along a second height between the seat and the desk, the second height being shorter than the first height.

* * * * *